US007120091B1

(12) United States Patent
Lizzi

(10) Patent No.: US 7,120,091 B1
(45) Date of Patent: Oct. 10, 2006

(54) ELECTRONIC DEVICE WITH CALENDAR FUNCTION

(75) Inventor: Ronald S. Lizzi, Bethany, CT (US)

(73) Assignee: Timex Group B.V., (NL)

( * ) Notice: Subject to any disclaimer, the term of this patent is extended or adjusted under 35 U.S.C. 154(b) by 0 days.

(21) Appl. No.: 11/211,412

(22) Filed: Aug. 25, 2005

(51) Int. Cl.
*G04B 19/24* (2006.01)
*G04B 19/20* (2006.01)

(52) U.S. Cl. ..... 368/37

(58) Field of Classification Search ..... 368/28, 368/35–38

See application file for complete search history.

(56) References Cited

U.S. PATENT DOCUMENTS

| | | | | |
|---|---|---|---|---|
| 3,901,017 | A * | 8/1975 | Emi et al. | 368/37 |
| 3,982,388 | A * | 9/1976 | Guyot et al. | 368/35 |
| 4,257,113 | A * | 3/1981 | Meister et al. | 368/35 |
| 6,081,483 | A * | 6/2000 | Capt et al. | 368/28 |
| 6,934,221 | B1 * | 8/2005 | Willemin et al. | 368/28 |
| 7,031,227 | B1 * | 4/2006 | Huter | 368/37 |
| 2005/0174891 | A1 * | 8/2005 | Besse | 368/37 |
| 2006/0028918 | A1 * | 2/2006 | Groothuis et al. | 368/37 |

* cited by examiner

*Primary Examiner*—Vit W. Miska
(74) *Attorney, Agent, or Firm*—Carmody & Torrance LLP

(57) ABSTRACT

An electronic device comprising a display assembly comprising a dial having a viewing window, the electronic device comprising a first rotateable ring having a plurality of dates thereon; a second rotateable ring having an extending portion that overlies the first ring, wherein the extending portion has a plurality of dates thereon; means for rotating the first rotateable ring so as to cause a selected subset of the plurality of dates to be positioned within in the viewing window; and rotating the second rotateable ring so as to cause a selected subset of the plurality of dates to be visible in the viewing window; wherein the overlying of the extending portion of the second rotateable ring over the first rotateable ring causes dates of the first rotateable ring positioned in the viewing window to be non-viewable in the viewing window; and selected rotation of the first and second rotateable rings causes different subsets of the respective plurality of dates on the respective rotateable rings to be positionable in the viewing window; whereby the position of the extending portion of the second rotateable ring over the first rotateable ring in the viewing window causes the viewability of differing sequences of dates in the viewing window.

15 Claims, 5 Drawing Sheets

ELECTRONIC DEVICE WITH CALENDAR FUNCTION

BACKGROUND OF THE INVENTION

The present invention relates to electronic devices such as timepieces in general and wristwatches in particular, and specifically, to an improved construction and methodology for displaying and conveying date information. Most advantageously although not limited thereto, the present invention is applicable to timepieces typically referred to as "analog" or "quartz-analog" watches having hands for displaying time.

Analog timepieces that indicate the date are well known. Most typically, a small window, such as at the 3 o'clock position, is provided in the dial and allows for the viewability of sequential dates on a date ring positioned below the dial. Other constructions, such as a hand that points to a series of dates displayed on the dial, are known as well.

However, it is believed that further advances are both desirable and achievable. For example, it would be desirable to be able to display a plurality of dates, such as a week (e.g. seven (7) days) at a glance with accurate date information (e.g. taking into account months with 28, 29, 30 and/or 31 days), thereby providing the user with the benefits of a small calendar, thus allowing the user the advantageous opportunity to view dates other than only the "current" (i.e. present) date.

Accordingly, it is desirable to provide a timepiece with an improved calendar function that overcomes perceived deficiencies in the prior art and further achieves the aforementioned and below mentioned objectives.

SUMMARY AND OBJECTIVES OF THE INVENTION

Accordingly, it is an objective of the present invention to provide an electronic device with an improved calendar function.

It is another objective of the present invention to provide an electronic device with an improved calendar display.

More specifically, it is an objective to provide an improved calendar function and display in what is typically referred to as an "analog" watch, such as providing a display of a plurality of dates at a glance with accurate date information (e.g. taking into account months with 28, 29, 30 and/or 31 days).

Still other objects and advantages of the invention will in part be obvious from the specification.

The invention accordingly comprises the features of construction, combination of elements, arrangement of parts and sequence of steps which will be exemplified in the construction, illustration and description hereinafter set forth, and the scope of the invention will be indicated in the claims.

Generally speaking, in accordance with the present invention, an improved electronic device comprising a display assembly comprising a dial having a viewing window is provided. In a preferred embodiment, the electronic device comprises two rotateable rings each having a plurality of dates thereon, means for rotating the first rotateable ring so as to cause a selected subset of the plurality of dates to be positioned within in the viewing window and rotating the second rotateable ring so as to cause a selected subset of the plurality of dates to be visible in the viewing window, wherein the overlying of the second rotateable ring over the first rotateable ring causes dates of the first rotateable ring positioned in the viewing window to be non-viewable in the viewing window; and selected rotation of the first and second rotateable rings causes different subsets of the respective plurality of dates on the respective rotateable rings to be positionable in the viewing window, whereby the position of the second rotateable ring over the first rotateable ring in the viewing window causes the viewability of differing sequences of dates in the viewing window.

In yet another embodiment, the second rotateable ring may be replaced by a mere rotateable member, which may be in the form of a mere elongated member (short of a complete ring) or portion of a ring/disc (e.g. in the shape of a "slice of pizza").

In a preferred embodiment, a display hand is also provided for indicating the "current" date from the plurality of visible dates in the viewing window.

BRIEF DESCRIPTION OF THE DRAWINGS

For a fuller understanding of the invention, reference is had to the following description taken in connection with the accompanying figures, in which.

Also, while not all elements are labeled in each figure, all elements with the same reference number indicate similar or identical parts.

DETAILED DESCRIPTION OF THE PREFERRED EMBODIMENTS

Figure 1:
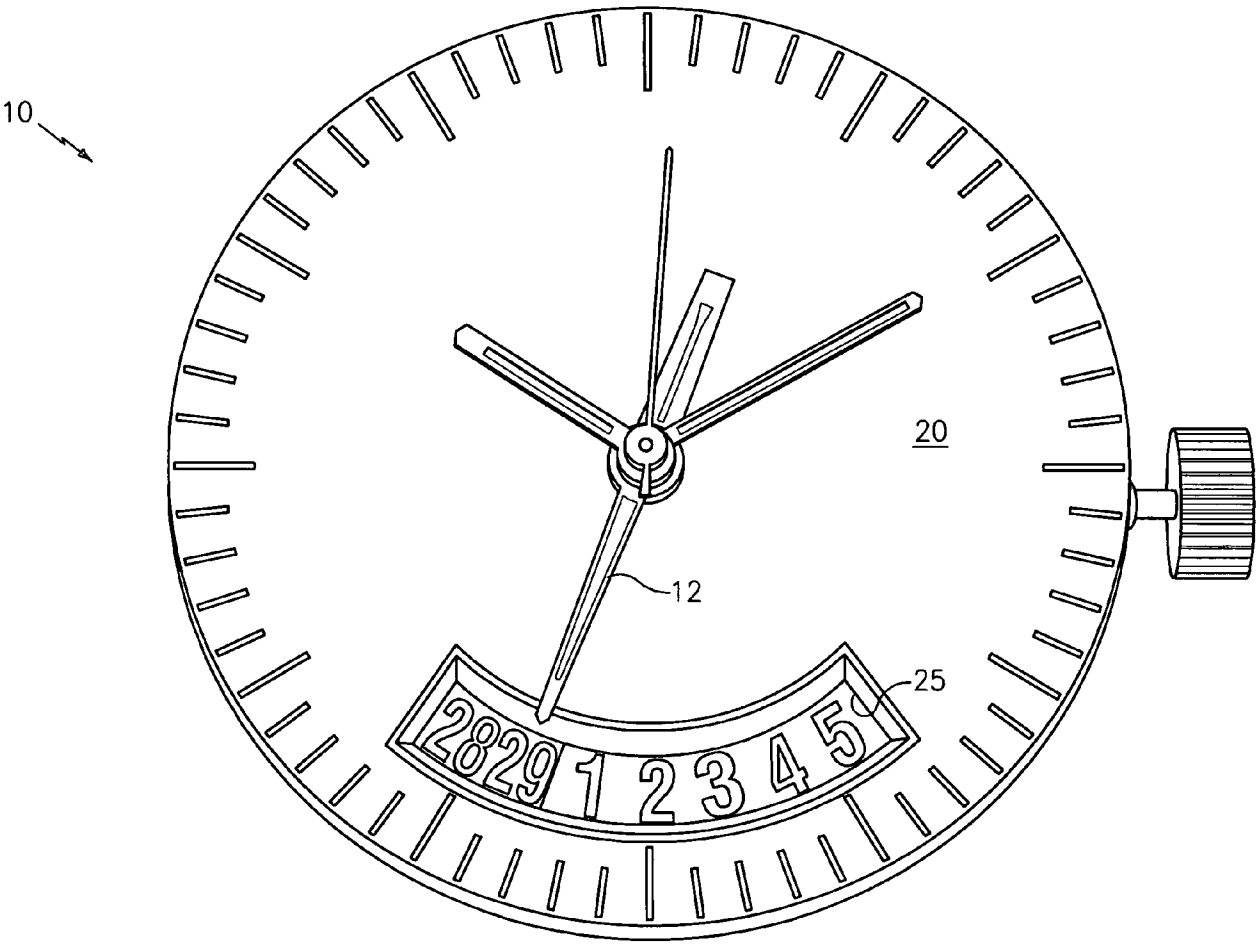
FIG. 1 is a top plan view of a date display assembly, constructed in accordance with the present invention, applicable for an electronic device of the type disclosed herein.
Figure 2:
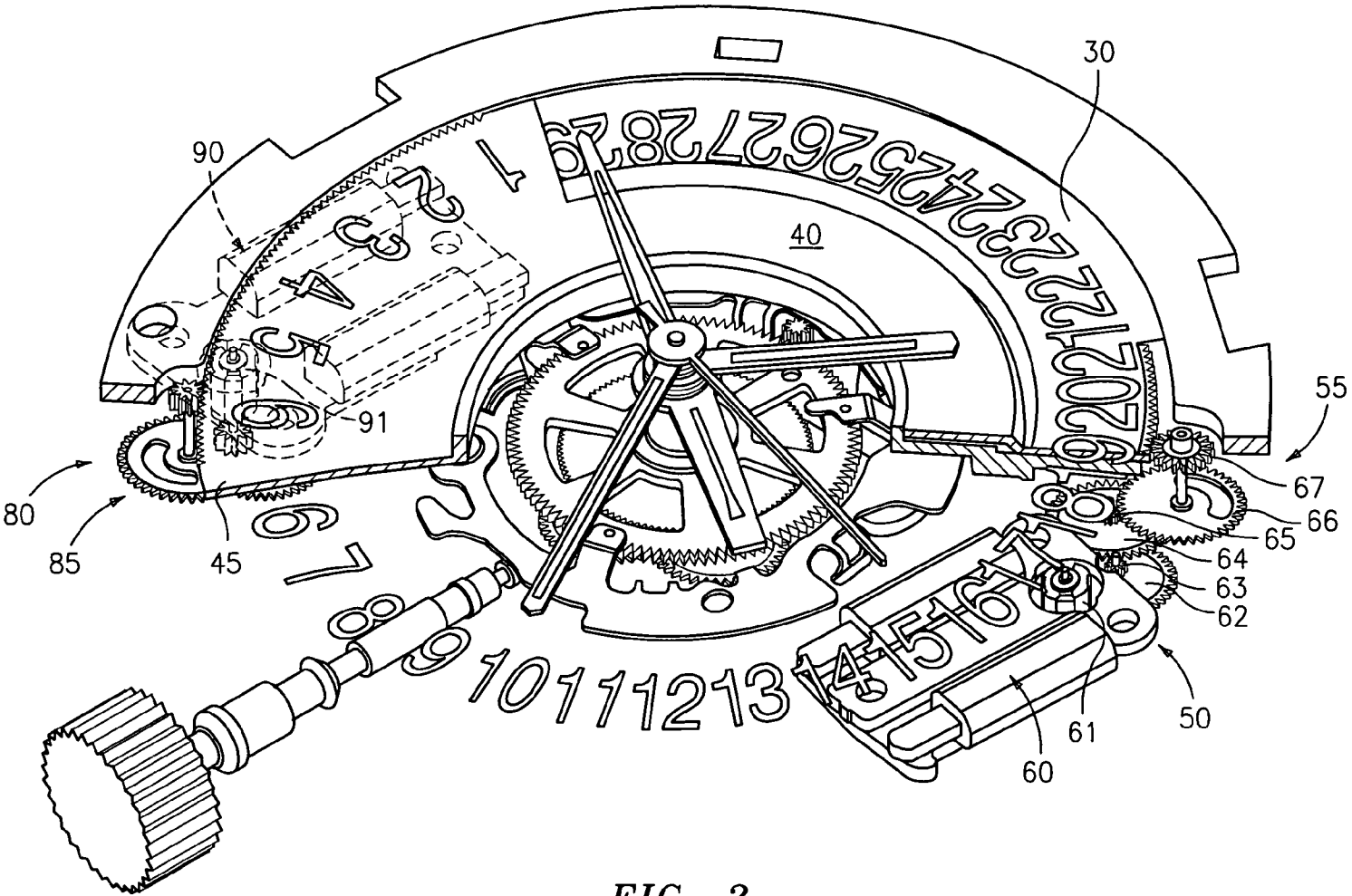
FIG. 2 is a perspective cut-away view of the date display assembly of FIG. 1, constructed in accordance with a first embodiment of the present invention.
Figure 3:
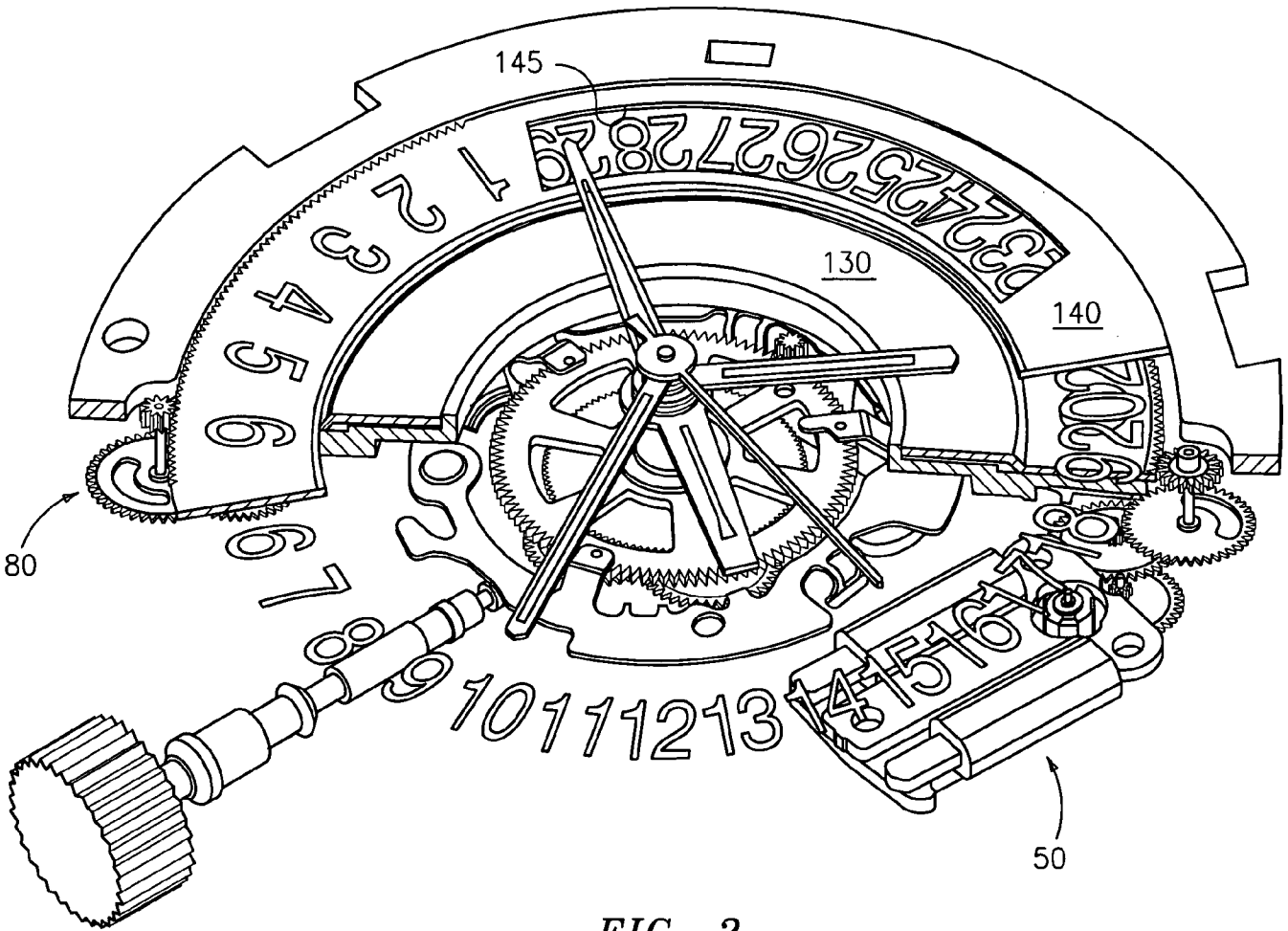
FIG. 3 is a perspective cut-away view of the date display assembly of FIG. 1, constructed in accordance with a second embodiment of the present invention.

Reference is first made generally to FIGS. 1–3, which illustrates a display assembly, generally indicated at 10, constructed in accordance with the present invention. In the preferred construction, display assembly 10 is part of an electronic device 5, which is preferably a timepiece in general and a wristwatch in particular. Constructing electronic device 5 with the particulars of display assembly 10, as disclosed herein, would be within the purview of one skilled in the art. Thus, electronic device 5 may comprise other features and parts not material to the present invention. Non-essential details of the present invention can be found in coowned and copending U.S. application Ser. No. 10/441,417, the subject matter of which is fully incorporated by reference herein.

To carry out the foregoing objectives, the electronic device of the present invention, and as illustrated in FIG. 1, comprises display assembly 10, which itself comprises a dial 20 having a viewing window 25. The construction of a conventional dial and timekeeping functionality is well within the scope of the routinely skilled artisan.

Reference will now be made to FIG. 2, illustrating a first embodiment of the present invention.

Specifically, display assembly 10 comprises an outer rotateable ring 30 having a plurality of dates thereon and an inner rotateable ring 40 having an extending portion 45 that overlies, at any point in time, a section of first ring 30. As illustrated, first rotateable ring 30 comprises the numbers "1"–"31", sequentially ordered, and extending portion 45 comprises the numbers "1"–"6", sequentially ordered. As one skilled in the art would know, such numbers can be printed, painted, silk-screened or otherwise adhered to or placed on the respective rings.

As will be set forth in greater detail below, electronic device 5 includes means for (i) rotating first rotateable ring 30 so as to cause a selected subset of the plurality of dates to be positioned within viewing window 25 and (ii) rotating second rotateable ring 40 so as to cause a selected subset of the plurality of dates to be visible in viewing window 25. For example, as illustrated in FIG. 1, ring 40 has dates "1," "2," "3," "4" and "5" visible in viewing window 25, while ring 30, although having dates "28," "29," "30," "31,""1," "2" and "3" positionable in viewing window, only dates "28" and "29" are viewable due to the overlying of ring 30 by a section of extending portion 45. That is, the overlying of extending portion 45 of second rotateable ring 40 over first rotateable ring 30 causes dates of the first rotateable ring positioned in the viewing window to be non-viewable in viewing window 25.

Selected rotation of first and second rotateable rings 30, 40 causes different subsets of the respective plurality of dates on the respective rotateable rings to be positionable in viewing window 25. That is, by rotating the rings either clockwise or counterclockwise, differing dates will be viewable in window 25. For example, FIG. 1 illustrates a month having only 29 days (e.g. February), and an exemplary embodiment wherein the $1^{st}$ day of the week (e.g. Sunday, as standard in the U.S. or Monday, as standard in Europe) is February $28^{th}$. The additional feature whereby the actual "current" day is indicated is disclosed below. Preferably, upon the beginning of the "next" week, ring 30 will rotate 9×(360°/31) in the clockwise direction so that the first date visible on ring 30 in window 25 is "6." However, ring 40 will rotate 5×(360°/31) in the counterclockwise direction so that no dates of ring 40 are visible in window 25. Clearly, it is within the purview of one skilled in the art to rotate ring 40 in a different manner (e.g. clockwise) to remove all the dates from being positioned in window 25, but the preferred embodiment is as set forth above in order to reduce the work of the rotating means (e.g. stepping motors), as set forth below. As should now be understood in the art, the amount of rotation of ring 40 depends upon the first day of the week as well as the number of days in any given month. For example, were the first day of the week the $28^{th}$ of a month having 30 days, upon the first day of the subsequent week, ring 40 would need to rotate only 4×(360°/31).

As should now be understood, the position of extending portion 45 of second rotateable ring 40 over first rotateable ring 30 in viewing window 25 causes the viewability of differing sequences of dates. However, it should be understood that extending portion is most optimally used during months having less than 31) days.

As illustrated in FIG. 2 and with respect to the first embodiment, the aforementioned means preferably comprises:

a first assembly, generally indicated at 50, comprising:

(i) a first gearing assembly generally indicated at 55, comprising one or more wheels being meshingly coupled to first rotateable ring 30 so that the rotation of the one or more wheels causes the rotation of first rotateable ring 30; and (ii) a first stepping motor 60 comprising a rotor 61, wherein the rotor of stepping motor 60 is rotateably coupled to the at least one or more wheels of first gearing assembly 55, wherein the rotation of rotor 61 causes the rotation of first rotateable ring 30; and a second assembly, generally indicated at 80, comprising:

(i) a second gearing assembly generally indicated at 85, comprising one or more wheels being meshingly coupled to second rotateable ring 40 so that the rotation of the one or more wheels causes the movement of second rotateable ring 40; and (ii) a second stepping motor 90 comprising a rotor 91, wherein the rotor of stepping motor 90 is rotateably coupled to the at least one or more wheels of second gearing assembly 80, wherein the rotation of rotor 91 causes the rotation of second rotateable ring 40.

Although it is believed that the construction of the aforementioned first and second assemblies 50 and 80 are well within the purview of the skilled artisan, the following is set forth for completeness, with particular reference being made to assembly 50. Assembly 80 is constructed in a similar manner.

Assembly 50 comprises stepping motor 60 and gearing assembly 55, comprising one or more wheels operatively coupled to motor 60. Stepping motor 60, which is preferably a bi-directional motor, comprises rotor 61 that is rotateably coupled to at least a first of the wheels of the gearing assembly. That is, the rotor will preferably comprise teeth that meshingly align with the outer teeth of a first wheel 62. In turn, first wheel 62 includes a pinion 63 which itself has teeth that meshingly align with teeth on the outer circumference of a second wheel 64. Second wheel 64 comprises a pinion 65 which itself has teeth that meshingly align with teeth on the outer circumference of a third wheel 66. This third wheel 66 likewise comprises a pinion 67 which itself has teeth that meshingly align with teeth on the outer circumference of ring 30. In this way, the rotation of rotor 61 of motor 60 can cause the rotation of ring 30. It should be understood that the number of wheels and number of teeth on each wheel may be more or less (or different as the case may be) than that set forth herein, and are really one of design choice for the intended function and based upon a number of known criterions, such as power and torque constraints. The selection of a suitable stepping motor and the arrangement and/or positioning of the components are all within the purview of one skilled in the art. Likewise, rings 30 and/or 40 may alternatively be driven by teeth on their inner circumference.

In the preferred embodiment, assemblies 50 and 80 are similarly constructed, so no further details of assembly 80 are needed or necessary.

Although it should be obvious to the reader in view of the illustration of FIG. 1, the dates on the respective rotateable rings that are not positioned within viewing window 25 are preferably not viewable. For example, dates "27," "26," "25" . . . on ring 30 are not viewable in window 25 since they are not positionable therein (this is aside from the foregoing discussion that the overlapping of dates by extending portion 45 can also cause dates that are in fact positioned in window 25 from being viewable). To allow for the viewability of a "week-at-a-glance," window 25 is preferably dimensioned to permit the viewability of seven (7) dates at any one time.

Reference will now be made to FIG. 3, which sets forth a date display assembly constructed in accordance with a second embodiment of the present invention.

In this second embodiment there is provided again a first rotateable ring 130 having a plurality of dates thereon and a second rotateable ring 140, overlying at least a portion of first rotateable ring 30. Ring 130 has provided thereon the same numbers, e.g. "1" to "31" as does ring 30, and ring 140 has provided thereon the same numbers, e.g. "1" to "6," as does ring 40. However, ring 140 is different from ring 40 in that essentially the entire ring 140 overlies ring 130, with a portion of ring 140 cut out so that a plurality of dates (in the preferred embodiment being at least seven (7)) dates) of ring 130 are viewable therethrough. The cut-out portion of ring 140 is indicated with reference number 145. Other than the constructions of the rings themselves, in all other material respects the display assemblies of the first two embodiments are the same. For example, the display assembly of this second embodiment likewise comprises means (i.e. assemblies 50, 80) for rotating the first rotateable ring so as to cause a selected subset of the plurality of dates to be positioned within the viewing window and rotating the second rotateable ring so as to cause a selected subset of the plurality of dates to be visible in the viewing window. In the preferred embodiment, the foregoing means of this second embodiment are identical to the means set forth above (i.e. stepping motors and gearing assemblies) with respect to the first embodiment.

In a similar manner, the overlying of second rotateable ring 140 over the first rotateable ring 130 may cause numerals of first rotateable 130 ring positioned in the viewing window to be non-viewable in the viewing window. Likewise, selected rotation of the first and second rotateable rings causes different subsets of the respective plurality of dates on the respective rotateable rings to be positioned within the viewing window, whereby the position of the second rotateable ring over the first rotateable ring in the viewing window causes the viewability of differing sequences of dates in the viewing window.

It can thus be seen that the present invention provides an improved calendar function and display in what is typically referred to as an "analog" watch, such as providing a display of a plurality of dates at a glance that accurately takes into account months with 28, 29, 30 and/or 31 days. Also, while essentially the same construction, the first embodiment (FIG. 2) may provide less frictional engagement between the rings than does the second embodiment (FIG. 3). However, those skilled in the art should be able to take the foregoing into account in any contemplated construction.

In a preferred aspect of the present invention, a display hand, such as hand 12, is used to point in the direction of a date viewable in window 25, thereby allowing an indication of the specific then "current" date. As set forth above, in the preferred embodiment, the first viewable date is the first day of the week (as opposed to the "current" date). Hand 12, which is preferably rotateable about an axis (centered about dial 20 or otherwise), is also operatively coupled to an actuation mechanism, such as a stepping motor (not shown) for rotating display hand 12 in at least one of a clockwise and counterclockwise direction. In this way, hand 12 is used to indicate the "current" date, which in FIG. 1 is the "$29^{th}$", as well as the day of the week (e.g. $1^{st}$ day of the week, $2^{nd}$ day of the week, etc) by virtue of its position. Details of a gear train and stepping motor that comprise the assembly to rotate hand 12 is exemplary set forth in greater detail in the aforementioned copending application Ser. No. 10/441,417.

In the preferred embodiments, motors 60, 80 (and the motor to rotate hand 12) are bi-directional stepper motors thus being able to rotate in either direction, and the construction of acceptable stepper motors to functionally operate in this manner are widely available and well within the understanding of those skilled in the art.

To provide the proper and accurate controlling, positioning and rotation of rings 30/130 and 40/140 (as well as hand 12), a controller is provided. Details of a controller for controlling either of the aforementioned two display assemblies can be found in the aforementioned '417 application with reference to controller 100 therein, and the controller of the present invention preferably comprises all of the functional features described therein to carry out the objectives and features of the present invention. The added functionality particular to the present invention shall now be disclosed.

Figure 4:
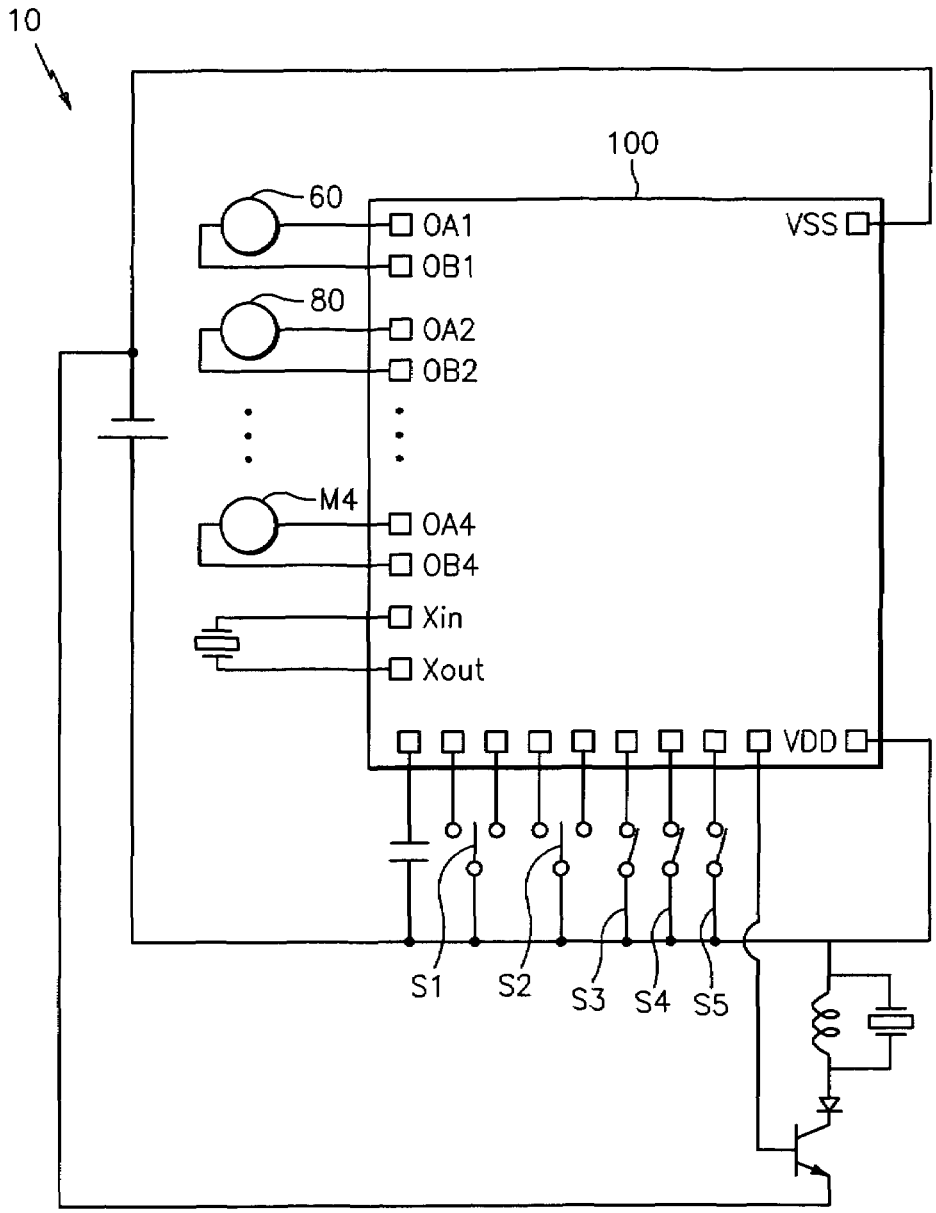
FIG. 4 is a circuit diagram for an electronic device constructed in accordance with the present invention.

General reference may be made to FIG. 4 for a partial block diagram of the electronic device of the present invention (e.g. electronic device 10), which illustrates among other things, interface connections to motors 60, 80, M3 and M4 (which generically represent the motors for hand 12 and the hour and minute hands, respectively) and switches S1–S5. Switches S1–S5 are intended to generically indicate both side/top mounted pushers, as well as side mounted rotateable crowns, and thus respond to the actuation (i.e. pulling and/or pushing) action thereof. In the case of crowns, the pulling and or pushing actuations may be provided for setting the hour and minute hands and/or calibrating hands 12 on the one hand and/or calibrating and/or manually rotating rings 30/130 and 40/140 on the other. A preferred hand and disc calibration methodology and arrangement is disclosed in the aforementioned '417 application and in copending and coowned application Ser. No. 10/737,406 the subject matter which is likewise incorporated by reference as if fully set forth herein. In this way, it is always possible to calibrate (i.e. initialize the position of) hand 12 and/or rings 30/130 and 40/140 so that controller 100 knows their respective positions. An input/output control circuit 110 controls the crown actuations and pushbutton switches and provides such signaling information to CPU 101.

Figure 5:
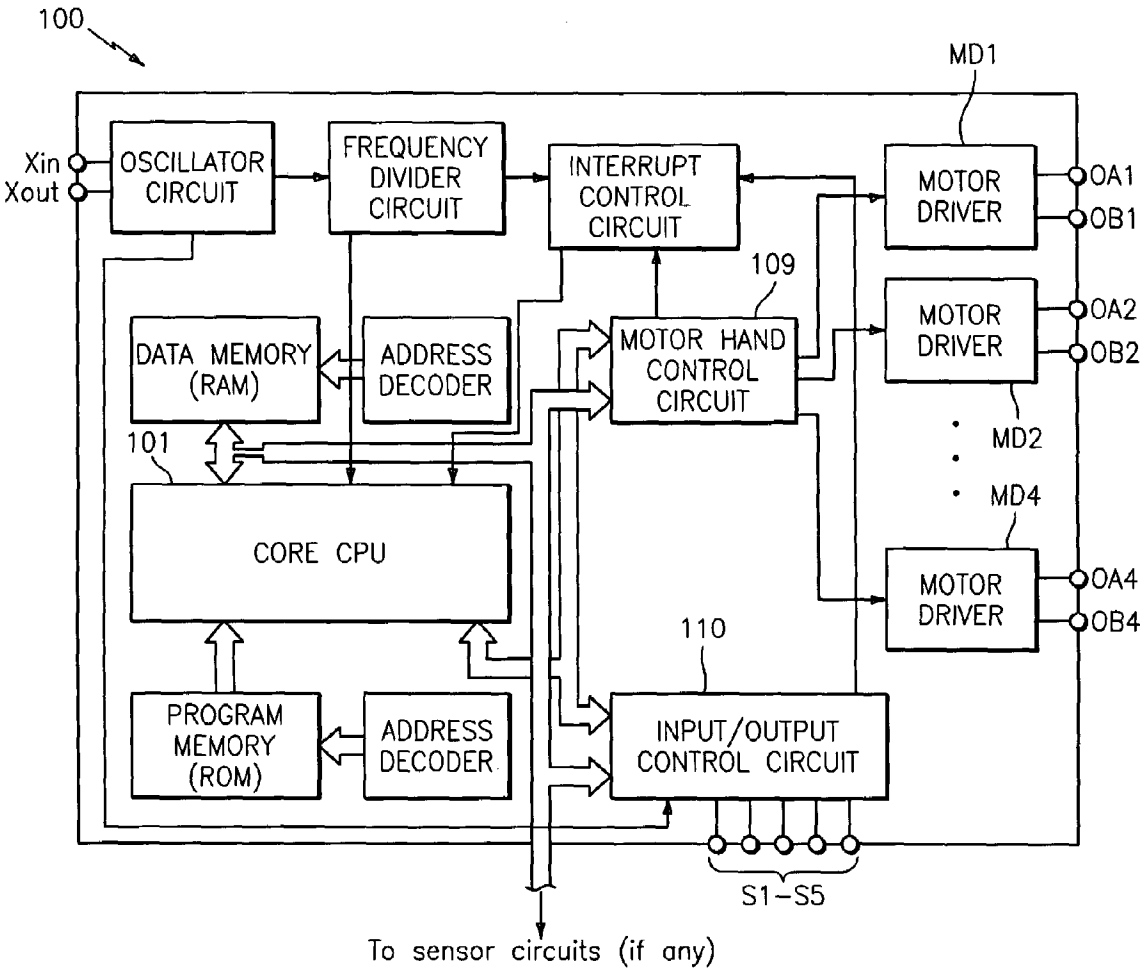
FIG. 5 is a block diagram of a controller for use in an electronic device constructed in accordance with the present invention.

Reference may also be made to FIG. 5, which illustrates a block diagram of controller 100. Particular reference is made to motor control circuit 109, which receives a commanded "next number of pulses" from CPU core 101 and generates the pulsed and phased signals necessary to move a desired motor (60, 80, M3, M4) a desired amount and in a desired direction. Pulse outputs of motor control circuit 109 are buffered by motor drivers MD1, MD2, MD3, and MD4 and applied to respective motors 60, 80, M3, M4.

Although the preferred embodiment provides that controller 100 is highly integrated wherein all timing and display functionality is controlled in controller 100, alternate embodiments could separate the timekeeping functions from those processing and displaying stored or sensed data, as would be understood by one skilled in the art. In addition, known programming techniques, through software and/or switch actuation sequences if desired, are preferably used to program controller 100 so that it "knows" and or otherwise maintains accurate day and date information (i.e. what month the electronic device is in and how many days are in that particular month, etc.). Such functionality and programming features are well within the purview of one skilled in eh art Known methodologies provide for the smooth rotation of rings 30/130 and 40/140. For example, the rings may rotate upon the detection of a set of 24 hour periods or may rotate upon the sufficient rotation of the hour hand (e.g. see U.S. application Ser. No. 10/716,011, the subject matter of which is incorporated by reference herein in its entirety). Well known programming techniques such as those described in the applications incorporated herein by reference set forth acceptable methodologies of ensuring proper, sufficient and accurate stepping of the stepping motor(s). Specifically, these known techniques allow controller 100 to determine whether and when to signal motor control circuit 109 to step the respective stepper motor so that a hand or ring should rotate, and by how much. Additionally, subsequent dates (or the next week) can be displayed by manual actuation of a pusher.

It will thus be seen that the present invention is both patentably different from and a significant improvement over known date displays. Specifically, the present invention provides a unique date display assembly, and provide two unique ways (e.g. rotation of the rings themselves and/or the use of a display hand (i.e. hand 12)) to indicate the then "current" day and a unique way to see a plurality of dates at a glance, thus providing an additional benefit to the user.

While the invention has been particularly shown and described with respect to preferred embodiments thereof, it will be understood that changes in form and details may be made therein without departing from the scope and spirit of the invention. For example, in place of a ring 40 or 140, an elongated member or portion of a disc/ring (e.g. shaped like a "slice of pizza") may be used. That is, as seen in FIG. 2, it is contemplated that ring 40 need not extend fully into a ring, and therefore a truncated ring (i.e. a mere elongated member or an otherwise portion of a ring) can be used in place thereof, a construction that would be within the purview of one skilled in the art having been provided with the disclosure herein.

What is claimed is:

1. An electronic device comprising a display assembly comprising a dial having a viewing window, the electronic device comprising:

a first rotateable ring having a plurality of dates thereon;

a second rotateable ring having an extending portion that overlies the first ring, wherein the extending portion has a plurality of dates thereon;

means for:

rotating the first rotateable ring so as to cause a selected subset of the plurality of dates to be positioned within in the viewing window; and rotating the second rotateable ring so as to cause a selected subset of the plurality of dates to be visible in the viewing window;

wherein:

the overlying of the extending portion of the second rotateable ring over the first rotateable ring causes dates of the first rotateable ring positioned in the viewing window to be non-viewable in the viewing window; and selected rotation of the first and second rotateable rings causes different subsets of the respective plurality of dates on the respective rotateable rings to be positionable in the viewing window;

whereby the position of the extending portion of the second rotateable ring over the first rotateable ring in the viewing window causes the viewability of differing sequences of dates in the viewing window.

2. The electronic device as claimed in claim 1, wherein the means comprises:

a first assembly comprising:

a first gearing assembly, comprising one or more wheels, being meshingly coupled to the first rotateable ring so that the rotation of the one or more wheels causes the rotation of the first rotateable ring; and a first stepping motor comprising a rotor, wherein the rotor of the stepping motor is rotateably coupled to the at least one or more wheels of the first gearing assembly, wherein the rotation of the rotor causes the rotation of the first rotateable ring; and a second assembly comprising:

a second gearing assembly, comprising one or more wheels, being meshingly coupled to the second rotateable ring so that the rotation of the one or more wheels causes the movement of the second rotateable ring; and a second stepping motor comprising a rotor, wherein the rotor of the stepping motor is rotateably coupled to the at least one or more wheels of the second gearing assembly, wherein the rotation of the rotor causes the movement of the second rotateable ring.

3. The electronic device as claimed in claim 1, wherein the dates on the respective rotateable rings that are not positioned within the viewing window are not viewable in the viewing window.

4. The electronic device as claimed in claim 1, wherein:

the dates on the first rotateable ring comprise numbers "1"–"31", sequentially ordered; and the dates on the second rotateable ring comprise numbers "1"–"6", sequentially ordered.

5. The electronic device as claimed in claim 4, wherein the viewing window is dimensioned to permit the viewability of seven (7) dates at any one time.

6. The electronic device as claimed in claim 1, comprising at least one display hand rotateable about an axis and operatively coupled to an actuation mechanism for rotating the at least one display hand in at least one of a clockwise and counterclockwise direction;

wherein the display hand has a distal end that points in the direction of a digit that is viewable in the viewing window.

7. An electronic device comprising a display assembly comprising a dial having a viewing window, the electronic device comprising:

a first rotateable ring having a plurality of dates thereon;

a second rotateable ring, overlying the first rotateable ring, having a plurality of dates thereon;

means for:

rotating the first rotateable ring so as to cause a selected subset of the plurality of dates to be positioned within the viewing window; and rotating the second rotateable ring so as to cause a selected subset of the plurality of dates to be visible in the viewing window;

wherein:

the overlying of the second rotateable ring over the first rotateable ring causes dates of the first rotateable ring positioned in the viewing window to be non-viewable in the viewing window; and selected rotation of the first and second rotateable rings causes different subsets of the respective plurality of dates on the respective rotateable rings to be positioned within the viewing window;

whereby the position of the second rotateable ring over the first rotateable ring in the viewing window causes the viewability of differing sequences of dates in the viewing window.

8. The electronic device as claimed in claim 7, wherein the means comprises:

a first assembly comprising:

a first gearing assembly, comprising one or more wheels, being meshingly coupled to the first rotateable ring so that the rotation of the one or more wheels causes the rotation of the first rotateable ring; and a first stepping motor comprising a rotor, wherein the rotor of the stepping motor is rotateably coupled to the at least one or more wheels of the first gearing assembly, wherein the rotation of the rotor causes the rotation of the first rotateable ring; and a second assembly comprising:

a second gearing assembly, comprising one or more wheels, being meshingly coupled to the second rotateable ring so that the rotation of the one or more wheels causes the movement of the second rotateable ring; and a second stepping motor comprising a rotor, wherein the rotor of the stepping motor is rotateably coupled to the at least one or more wheels of the second gearing assembly, wherein the rotation of the rotor causes the movement of the second rotateable ring.

9. The electronic device as claimed in claim 7, wherein the dates on the respective rotateable rings that are not positioned within the viewing window are not viewable in the viewing window.

10. The electronic device as claimed in claim 7, wherein:

the dates on the first rotateable ring comprise numbers "1"–"31", sequentially ordered; and the dates on the second rotateable ring comprise numbers "1"–"6", sequentially ordered.

11. The electronic device as claimed in claim 10, wherein the viewing window is dimensioned to permit the viewability of seven (7) dates at any one time.

12. The electronic device as claimed in claim 7, comprising at least one display hand rotateable about an axis and operatively coupled to an actuation mechanism for rotating the at least one display hand in at least one of a clockwise and counterclockwise direction;

wherein the display hand has a distal end that points in the direction of a digit that is viewable in the viewing window.

13. An electronic device comprising a display assembly comprising a dial having a viewing window, the electronic device comprising:

a first rotateable ring having a plurality of dates thereon;

a rotateable member that overlies the first ring, wherein the rotateable member has a plurality of dates thereon;

one or more stepping motors and gearing assemblies for:

rotating the first rotateable ring so as to cause a selected subset of the plurality of dates to be positioned within in the viewing window; and rotating the rotateable member so as to cause a selected subset of the plurality of dates to be visible in the viewing window;

wherein:

the overlying of the rotateable member over the first rotateable ring causes dates of the first rotateable ring positioned in the viewing window to be non-viewable in the viewing window; and selected rotation of the first rotateable ring and the rotateable member causes different subsets of the respective plurality of dates on the respective first rotateable ring and the rotateable member to be positionable in the viewing window;

whereby the position of the rotateable member over the first rotateable ring in the viewing window causes the viewability of differing sequences of dates in the viewing window.

14. The electronic device as claimed in claim 13, wherein the rotateable member is a rotateable ring.

15. The electronic device as claimed in claim 13, wherein the rotateable member is a rotating elongated member.

* * * * *